United States Patent [19]

Hiraishi

[11] 4,276,632

[45] Jun. 30, 1981

[54] HATCH LOCKING MECHANISM FOR THE BATTERY COMPARTMENT OF A WRISTWATCH

[75] Inventor: Mamoru Hiraishi, Hino, Japan

[73] Assignee: Heiwado Boeki Kabushiki Kaisha, Tokyo, Japan

[21] Appl. No.: 77,186

[22] Filed: Sep. 20, 1979

[30] Foreign Application Priority Data

Sep. 22, 1978 [JP] Japan ..... 53-130635[U]
Mar. 23, 1979 [JP] Japan ..... 54-36986[U]

[51] Int. Cl.[3] ..... G04C 10/00; G04B 37/00

[52] U.S. Cl. ..... 368/203; 368/291; 368/309

[58] Field of Search ..... 58/23 BA, 55, 88 R, 58/90 R; 73/431; 220/256; 429/98; 368/203–205, 286, 291

[56] References Cited

U.S. PATENT DOCUMENTS 2,845,773 8/1958 Sakalys ..... 58/90 R
3,608,304 9/1971 Schaad ..... 429/98 X

*Primary Examiner*—Edith S. Jackmon

*Attorney, Agent, or Firm*—Pearne, Gordon, Sessions, McCoy & Granger

[57] ABSTRACT

A hatch locking mechanism is disclosed for a battery compartment having a mouth opening in the rear side of a wristwatch. The mechanism includes an inner cover adapted to be received within the battery compartment mouth and a central support shaft extending outwardly therefrom. An outer cover is slidably mounted around the support shaft and adapted to overlie the inner cover and battery compartment mouth. A first resilient seal member is disposed between the outer periphery of the inner cover and battery compartment mouth, and a second resilient seal member is disposed between the covers adjacent the support shaft. A lever pivotally connected to the support shaft is operable to bias the covers together and the seal members into sealing engagement when moved to a locking position to secure the hatch locking mechanism to the wristwatch and close the mouth of the battery compartment. In the locked position, the lever is contiguously disposed along the outer cover to provide the hatch locking mechanism with an outer surface which is flush with and continuous to an outer surface of a rear cap of the wristwatch.

17 Claims, 9 Drawing Figures

HATCH LOCKING MECHANISM FOR THE BATTERY COMPARTMENT OF A WRISTWATCH

BACKGROUND OF THE INVENTION AND PRIOR ART

The present invention relates to a hatch locking mechanism for the battery compartment of a wristwatch and, more particularly, to a novel and improved hatch locking mechanism which is operable by the pivotal movement of a lever. The movement of the lever to a locking position serves to move and lock a hatch cover for the battery compartment into sealing engagement with the watch case.

Heretofore, the changing of a wristwatch battery has required the removal of the rear cap of the watchcase and the battery changing operation has normally been left to a watchmaker, since the operation is too difficult to be performed by the user. However, it is desirable that the user be able to replace batteries and, in fact, there has already been proposed a wristwatch provided with a battery compartment formed at the rear side of the watchcase and including a hatch mechanism which enables this portion to be removed.

In a known hatch-type mechanism, the mouth of the battery compartment includes at its inner periphery an annular groove which receives a ring-shaped seal against which a hatch is screw-clamped. However, these components are relatively small and the operation is characterized by considerable difficulty, especially in positioning the seal at a predetermined location. Furthermore, the relatively higher sealing force normally employed to meet waterproof requirements results in the risk that the hatch may be lifted by the resiliency of the seal unless the hatch is screw-clamped with a sufficient depression exerted upon the hatch. Even when the screw is tightened with the right hand while a depression is exerted with a finger of the left hand upon the hatch, it is difficult to accomplish the desired operation. Even if the screw is properly tightened, a possible deviation of the seal from its predetermined position will reduce the water-proof effect. Formation of a thread around the hatch itself could somewhat facilitate the locking operation, but this necessarily increases the thickness of the hatch itself, often to an undesirable extent, since the modern wristwatch generally tends to have its thickness reduced more and more. With this measure, furthermore, the hatch configuration is limited to the circular one. Accordingly, this measure is not practical, since it is not applicable to the oval or square hatch, depending on the type of wristwatch.

A mechanism of the so-called "snap type," in which the hatch made of elastic material is also employed, and a mechanism in which the hatch can be locked with only a slight rotation thereof under a depression being exerted upon the hatch are also well known. In both cases, the operation of hatch locking is extremely difficult, since the hatch must be clamped while depressing the hatch with the finger after the seal has been positioned. In addition, a relatively high degree of precision is usually required in making the groove of the rear cap which is adapted to receive the seal, since the desired waterproof effect will be reduced unless the seal is brought into close contact with the groove.

SUMMARY OF THE INVENTION

In accordance with the present invention, a hatch is provided for the battery compartment of a wristwatch which can be locked by a one-touch operation and which includes a seal adapted to maintain a desired force of sealing or sealing pressure without the disadvantages encountered in prior art hatches.

In accordance with a first embodiment of the present invention, an arrangement is provided wherein the hatch comprises a pair of covers respectively provided with seals, one of the seals being urged closely against the mouth of the battery compartment along the inner periphery thereof as the pair of covers are brought into contact with each other. An operating lever for the hatch comprises a curved portion and a linear portion together defining a D-shaped closed loop which facilitates the finger operation thereof. The linear portion of the lever is centrally support-shaft-planted or mounted on the inner cover in a pivotal manner. The linear portion has a semicircular cross section so that a gap is provided between the pair of covers when the lever is vertically raised or transversely disposed to the covers in a hatch opening position. The covers are forced into contact with each other, with the peripheral seals being outwardly forced when the lever is brought down to a hatch closing position. The inner cover and the mouth of the battery compartment each have tapered peripheries so that the seal provided adjacent this zone is forced wedgewise into the gap defined between these two peripheries to keep the hatch perfectly sealed.

In accordance with a further aspect of the present invention, a hatch is provided which is substantially free from a feeling of incompatibility due to the irregularity or roughness of the hatch construction during use of the watch, and which can be smoothly locked and released. This is achieved, in accordance with a second embodiment of the present invention, by an arrangement wherein the outer surface of the hatch is substantially flush with the outer surface of the rear cap when the hatch has been locked, i.e., when the lever has been brought down. The hatch is provided with a groove to receive the lever and peripherally disposed notches to facilitate the raising of the lever to the hatch opening portion.

The hatch according to the present invention is not limited to a circular configuration; rather, it can be provided with various configurations such as oval or square, especially when two or more batteries are required depending on the type of watch. Obviously, it is also possible to size the hatch in accordance with any one of the various battery sizes. If the wristwatch includes a screw located adjacent the battery compartment for fine adjustment of movement, the screw may also be covered with the hatch in order to enable adjustment without removal of the rear cap of the watch.

BRIEF DESCRIPTION OF THE DRAWINGS

FIG. 8 is an elevational view on an enlarged scale illustrating the hatch as locked.

DETAILED DESCRIPTION OF THE DRAWINGS

A first embodiment of the present invention is described below with reference to FIGS. 1 to 3, wherein, except for the seals, sectional cross-hatching has been omitted for clarity of illustration.

Figure 1:
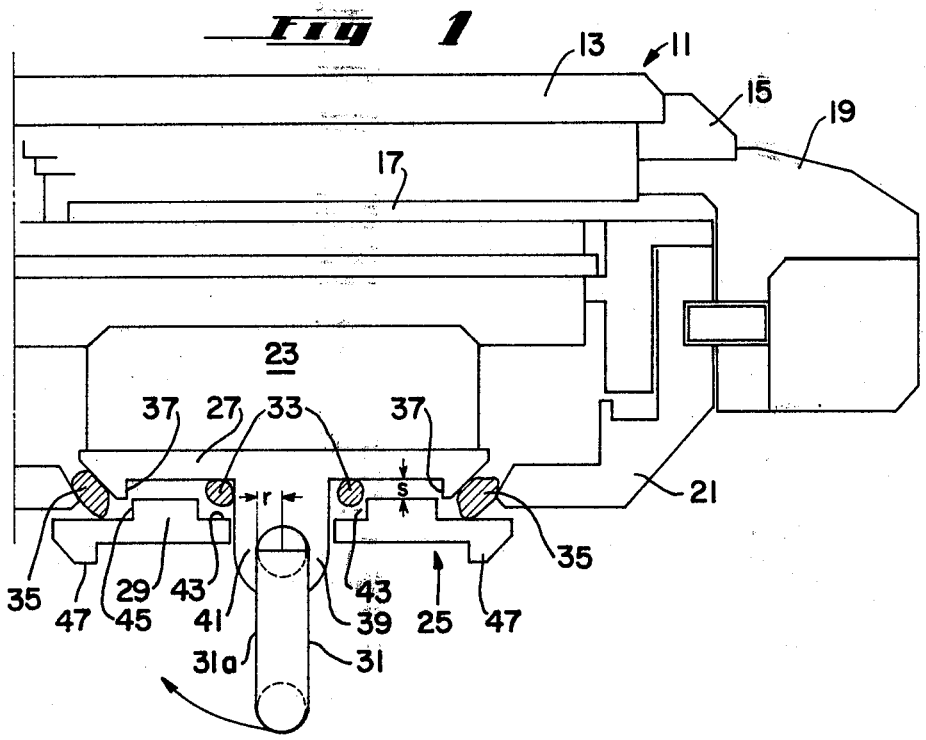
FIG. 1 is a vertical section showing a portion of a wristwatch having a hatch according to the first embodiment of the present invention, the hatch being shown in the released state.
Figure 2:
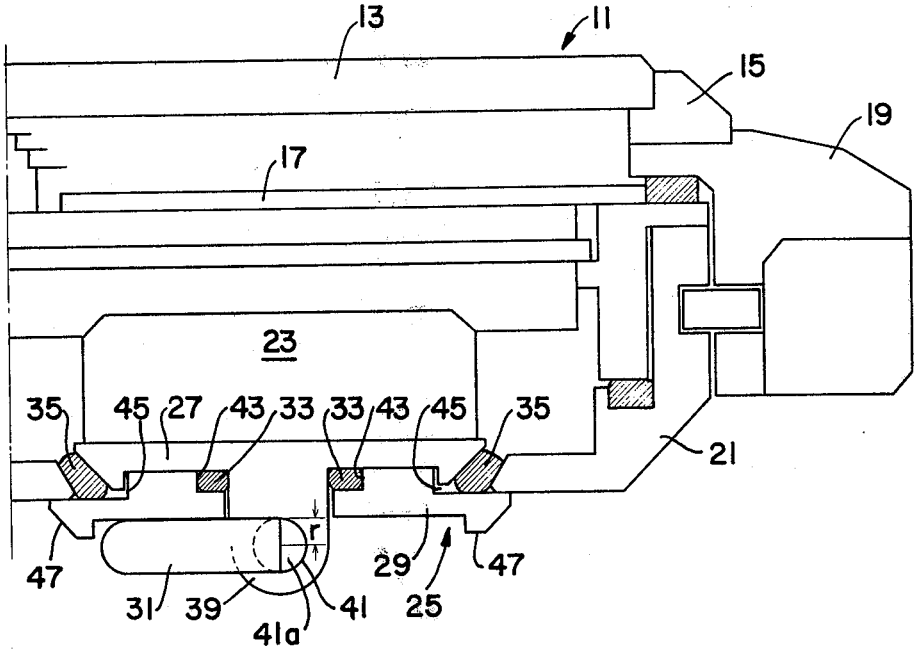
FIG. 2 is a section similar to FIG. 1, showing the hatch in the locked state.

Referring to FIG. 1, a lateral half of a wristwatch 11 is shown. The watch 11 comprises a front glass 13, a front cap 15 adapted to support the front glass, a watch face 17, a case 19, and a rear cap 21. A battery compartment 23 is formed at the rear side of the watch, and it is adapted to be covered by a hatch or a hatch locking mechanism 25.

The hatch 25 comprises an inner cover 27, an outer cover 29, an operating lever 31, and annular seals 33, 35. The inner cover 27 is discal and has an annular flange 37 tapered towards the bottom, as described hereinafter. The inner cover 27 is also provided with a centrally disposed support shaft 39. A bore 41 extends through the support shaft 39 transversely of the axis thereof to support the lever 31 in a pivotal manner.

The outer cover 29 has a disc shape, and it is of slightly larger diameter than the inner cover 27. The cover 29 is slidably mounted around the support shaft 39. Annular grooves 43,45 are formed along the inner and outer peripheries of one side of the cover 29 to receive associated seals 33,35. The opposite side of the cover 29 has an annular flange 47 along its periphery adapted to receive a curved portion of the lever 31 when the latter is brought down.

Figure 3:
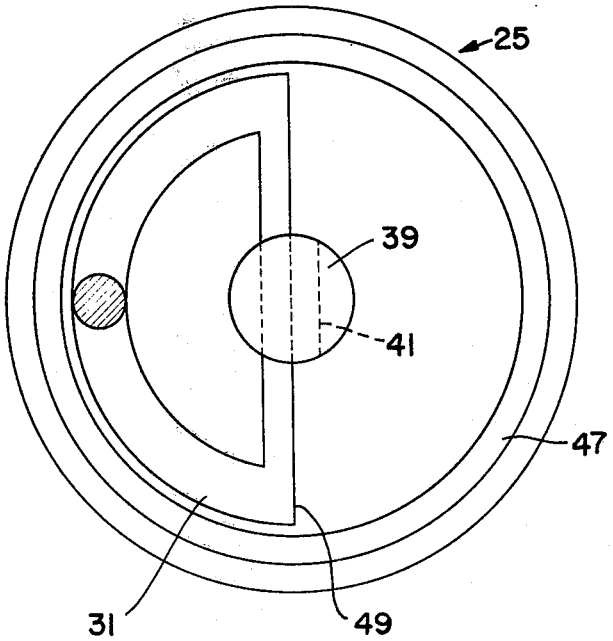
FIG. 3 is an elevational view showing the hatch.

The operating lever 31 comprises a D-shaped closed loop defined by the curved portion and a linear portion, as shown in FIG. 3, and a middle range or portion of the linear portion extends through the bore 41 formed in the support shaft 39. The curved portion of the lever 31 has a circular cross section, while the linear portion thereof has a semicircular cross section, including a planar surface 49, so that a cavity 41*a* having a semicircular cross section is defined within the bore 41 when the lever 31 is connected with the support shaft 39. It should be understood that the middle portion of the lever 31 that is engaged in the bore 41 of the support shaft 39 may be circular in cross section.

Figure 1A:
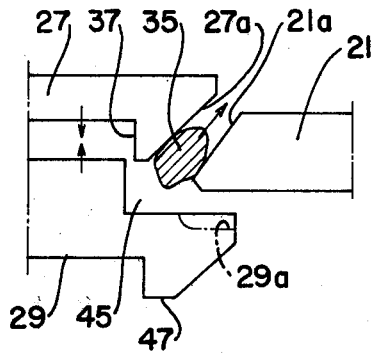
FIG. 1*a* is a sectional view on an enlarged scale showing the relative positions of the covers, the rear cap, and the seal.

FIG. 1*a* shows, in an enlarged section, a region in which the mouth of the battery compartment 23 is engaged with the hatch 25. The inner cover 27 and the rear cap 21 respectively present tapered peripheries or walls 27*a*, 21*a* which are not parallel to each other but, rather, are differentially tapered with respect to each other so as to define therebetween a gap gradually narrowed inwardly. In this manner, the seal 35 is forced wedgewise into the gap between these tapered peripheries and thereby provides a perfect sealing effect as the outer cover 29 is depressed. It should be appreciated that the sealing effect is further enhanced by the provision of an annular notch 29*a* along a planar portion of the groove 45, as shown in phantom outline, in FIG. 1*a*.

The manner in which the hatch 25 is opened and closed (i.e., released and locked) will now be considered. In the released state of the hatch 25, the lever 31 is in its vertical position transversely disposed with respect to the hatch, and the pair of covers 27, 29 define therebetween a gap having a distance S, as seen in FIG. 1. As the lever 31 is brought down in the direction indicated by the arrow through an angle of 90° from the above-mentioned position, one side 31*a* of the lever urges the outer cover 29 (actually, the inner cover 27 and the outer cover 29 pull each other) to establish a locked state as shown by FIG. 2. The swinging movement of the lever 31 provides a vertical stroke of the lever corresponding to a distance r (i.e., the radius of the lever in its cross section) as shown in FIG. 2. Accordingly, if the distance S between the pair of covers 27, 29 is preset to equal the stroke r, the covers 27 and 29 are brought into close contact with each other as the lever 31 is brought down.

In the locked state of the hatch, the annular seals 33, 35 provide their resilient sealing effects even if the dimensioning of the stroke r and the distance S is not in precisely corresponding relationship. The seal 35 serves to seal the gap defined by the rear cap 21, the inner cover 27 and the outer cover 29, while the seal 33 serves to seal the gap defined by the outer cover 29 and the support shaft 39, thus meeting the waterproof requirement for the wristwatch. By lifting the lever 31 from its locked position back to its vertical position, the hatch may be easily released, with the seal 35 being loosened with respect to the associated gap. It will be understood that obviously the lever 31 may be brought down to the right side or the left side in locking the hatch 25.

Figure 4:
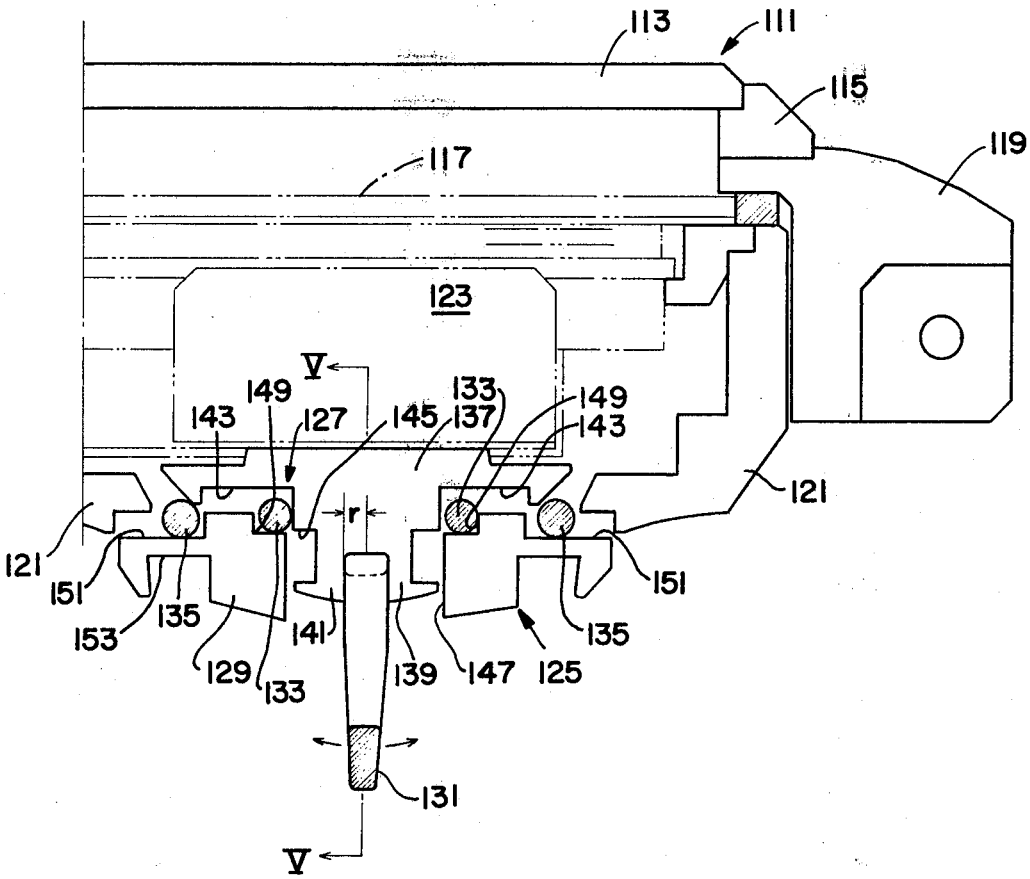
FIG. 4 is a vertical section showing a portion of a wristwatch having a hatch according to the second embodiment of the present invention, the hatch being shown in the released state.

The second embodiment is described below with reference to FIGS. 4 to 8. FIG. 4 shows in section a lateral half of a wristwatch 111 and the components, except for the seals, are again shown without cross-hatching for convenience of illustration. The second embodiment is similar to the first embodiment in general. The watch 111 includes a front glass 113, a front cap 115 adapted to support the front glass, a watch face 117, a case 119, and a rear cap 121. A battery compartment 123 is formed at the rear side of the watch and is adapted to be covered by a hatch or a hatch locking mechanism 125.

Figure 5:
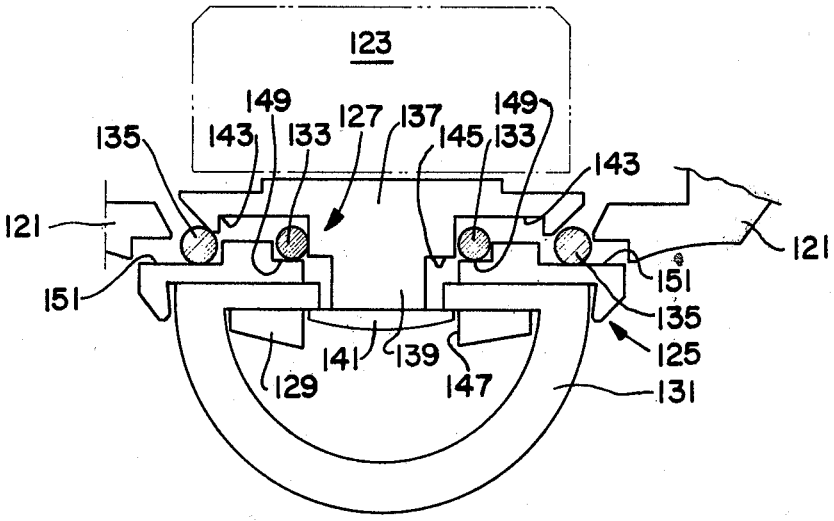
FIG. 5 is a section taken along a line 5—5 in FIG. 4.
Figure 7:
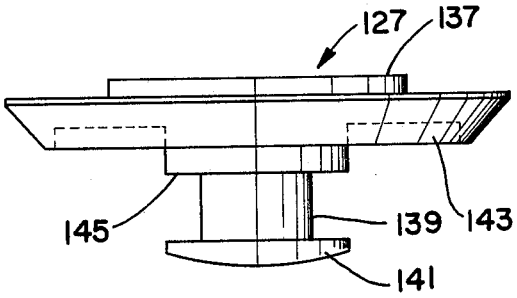
FIG. 7 is a side view illustrating the inner cover of the hatch.
Figure 6:
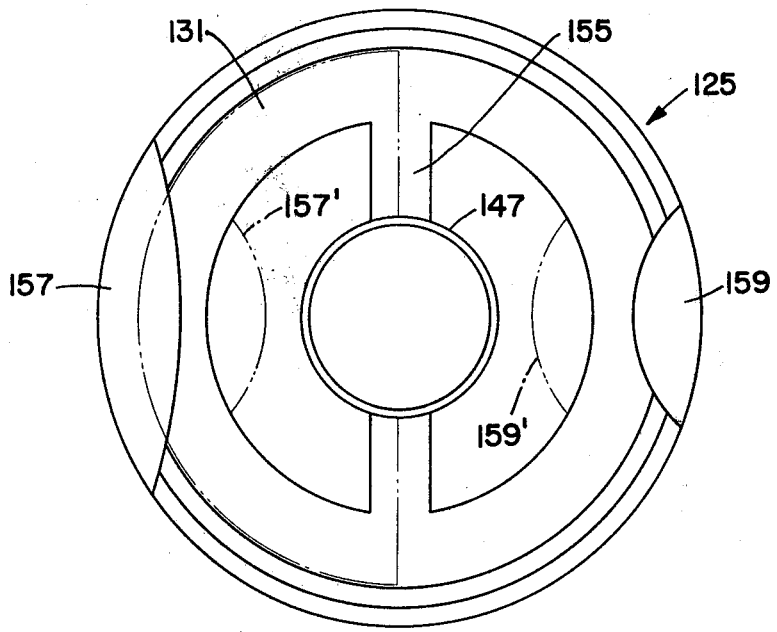

The hatch 125 comprises an inner cover 127, an outer cover 129, an operating lever 131, and annular seals 133, 135. As best shown in FIG. 7, the inner cover 127 has a discal portion 137, a shaft-like portion 139, and a flange-like portion 141. The discal portion 137 has an annular groove 143 adapted to be engaged with the outer cover 129 when the hatch 125 has been locked. The shaft-like portion 139 is interposed between a planar portion 145 of the disc and the flange 141, the latter, as shown in FIG. 5, supporting the lever 131 at the opposite ends thereof. The planar portion 145 engages a side surface of the lever 131 when the lever is brought down, as described in detail hereinafter.

The outer cover 129 is discal and includes a central bore 147 extending therethrough to receive the shaft-like portion 139 and the flange 141 of the inner cover 127. The outer cover 129 also includes in its upper surface (as seen in FIG. 4) two annular grooves 149 and 151, which are disposed in a concentric relationship to respectively receive annular seals 133 and 135. The lower surface of the outer cover 129 has an annular groove 153 to receive the lever 131 when the latter has been brought down in the locked state of the hatch 125.

The outer cover 129 is also provided with a diametrically extending groove 155, as shown in FIG. 8, to receive a linear portion of the lever 131.

Referring to FIG. 5, the manner in which the lever 131 is engaged with the shaft-like portion 139 of the inner cover 127 is shown. The linear portion of the lever 131 is interrupted at its middle region so that the opposed ends thereof are engaged with the inner surface of the flange 141 formed on the inner cover 127. This arrangement facilitates fabrication of the hatch as compared with the mounting of the lever in the first embodiment.

Figure 6:
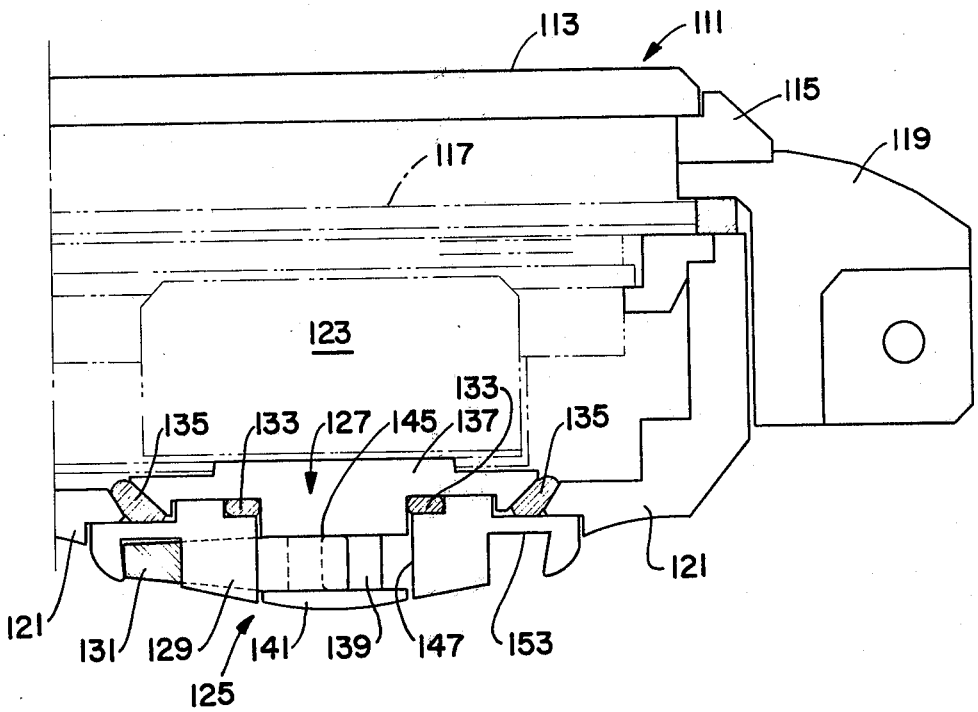
FIG. 6 is a vertical section illustrating how the hatch is locked.

The hatch 125 can be effectively locked by merely moving the lever 131 in either direction. FIG. 6 shows the hatch 125 in the state wherein the lever 131 has been moved in a clockwise direction so as to cause the inner cover 127 to be engaged with the outer cover 129 and the seals 133, 135 to be forced into the associated gaps defined between the covers. It will be understood that the stroke with which the hatch 125 is clamped by the lever 131 corresponds to the radius r, as shown in FIG. 4 with respect to the first embodiment.

An essential feature of the second embodiment will now be considered. As shown in FIG. 6, the outer surface of the hatch 125 presents a smoothly curved or planar configuration in the locked state of the hatch 125. Specifically, a dimensional relationship is chosen so that the outer surface of the rear cap 121, the outer cover 129 of the hatch, the lever 131, and the flange 141 are flush with one another. As a result thereof, the user is substantially free from a feel of incompatibility due to the hatch, even when the user carries the watch.

In order to facilitate the release of the hatch and raising of the lever 131, the outer cover 129 is peripherally provided with notches 157 and 159, as shown in FIG. 8. The notch 157 is sized to enable the lever 131 to be easily raised with a nail or a finger, while the notch 159 is sized to enable the lever 131 to be easily raised by means such as a pin. It is also possible to respectively form these notches at radially inward positions shown in phantom outline in FIG. 8. The feeing of incompatibility due to the hatch 125 may be further reduced by the use of a single notch and by defining the groove 153 of the outer cover 129 in conformity with a semicircular portion of the lever 131.

As reflected by the foregoing detailed description, the depression and locking displacement exerted upon the hatch automatically causes the seal to be forced into the gap defined between the tapered peripheries to provide the desired sealing effect and simultaneously causes the hatch to be locked with respect to the mouth of the battery compartment, according to the present invention. Furthermore, this operation is accomplished in a so-called one-touch manner, or only by bringing the lever down, so that the desired operation of opening and closing the hatch can be reliably performed even by the user of the watch for purposes of battery replacement. Furthermore, according to the present invention, the feeling of incompatibility due to the irregularity or unevenness of the hatch can be reduced to a minimum and the formation of the notches in the outer cover enables the hatch to be smoothly locked and released. Interruption of the linear portion of the lever to form the opposed ends which are engaged with the flange of the inner cover is advantageous from the viewpoint of fabrication and assembly.

Although the hatch has been described and illustrated in a circular configuration, it is also possible in accordance with the present invention to employ an oval or square hatch configuration depending on the individual cases. Accordingly, the specific embodiments described and illustrated are not intended to limit the present invention, which may be variously changed or modified without departure from the scope of the invention as defined by the claims.

What is claimed is:

1. A hatch locking mechanism for a battery compartment formed at the rear side of a wristwatch, characterized in that the hatch comprises an inner cover having a tapered outer periphery portion and a central support shaft, an outer cover slidably mounted around said support shaft and having grooves for receiving respective seals, an operating lever pivotally supported by said support shaft and having a planar surface extending along a linear portion thereof, and seals received by said grooves respectively; in that a mouth of the battery compartment peripherally has a tapered portion in opposition to said tapered outer periphery portion of the inner cover, with a taper angle slightly different from that of the latter so as to define a gap therebetween which is gradually reduced inwardly; and in that as said lever is brought down, the outer cover is so urged by a distance corresponding to a radius r of said lever in the axial section thereof that the seal is urged wedgewise into the gap defined between the tapered portions.

2. A hatch locking mechanism according to claim 1, wherein said hatch locking mechanism has a generally circular configuration.

3. A hatch locking mechanism according to claim 1, wherein said hatch locking mechanism has a generally oval configuration.

4. A hatch locking mechanism according to claim 1, wherein said hatch locking mechanism has a generally square configuration.

5. A hatch locking mechanism for a battery compartment formed at the rear side of a wristwatch, characterized in that the hatch locking mechanism includes an inner cover, an outer cover, seal means arranged to cooperate with said covers to seal a mouth opening of the battery compartment, and an operating lever pivotally connected to said inner cover, said lever being adapted to clamp said covers and seal means together in a biasing action to seal said mouth opening, and outer surface of the hatch locking mechanism being flush with and continuous to an outer surface of a rear cap of the watch when the hatch locking mechanism is locked, and the outer cover being provided with notches adapted to facilitate operation of the lever.

6. A hatch locking mechanism according to claim 5, wherein said notches are formed in an outer periphery of the outer cover.

7. A hatch locking mechanism according to claim 5, wherein said notches are formed inside a groove extending along the outer cover.

8. A hatch locking mechanism according to claim 5, wherein said lever includes a linear portion interrupted at a middle region thereof and the respective ends of the interrupted linear portion opposed to each other at the middle region are engaged with an inner surface of a flange formed on the inner cover.

9. A hatch locking mechanism according to claim 5, wherein said outer cover is formed with a groove to receive the lever when the hatch locking mechanism is locked.

10. A hatch locking mechanism according to claim 9, wherein the groove extends along a semicircle.

11. A hatch locking mechanism according to claim 9, wherein the groove extends along an annulus.

12. A hatch locking mechanism for a battery compartment having a mouth opening at the rear side of a wristwatch comprising an inner cover adapted to be received within said battery compartment mouth and having a central support shaft extending outwardly therefrom, a resilent seal member adapted to be disposed between said inner cover and battery compartment mouth, an outer cover adapted to be slidably mounted around said support shaft and to overlie said inner cover and battery compartment mouth, and an operating lever pivotally connected to said support shaft, said lever being operable to bias said covers toward one another and said seal member into sealing engagement between said inner cover and battery compartment mouth to secure the hatch locking mechanism to said wristwatch when said lever is moved to a locked position contiguously disposed along an outer surface of said outer cover.

13. A hatch locking mechanism as set forth in claim 12, wherein said lever in the locked position cooperates with said outer cover to provide the hatch locking mechanism with an outer surface which is flush with and continuous to an outer surface of a rear cap of the wristwatch.

14. A hatch locking mechanism as set forth in claim 12, wherein said outer cover includes a groove to receive said lever in the locked position and notches to facilitate access to the lever.

15. A hatch locking mechanism as set forth in claim 12, wherein said lever is also operable to enable said covers to be moved away from one another and said seal member to be withdrawn from sealing engagement between said inner cover and battery compartment mouth when the lever is moved to a released position.

16. A hatch locking mechanism as set forth in claims 12, 13, 14, or 15, wherein said battery compartment mouth includes a tapered wall portion extending about its periphery, said inner cover includes a tapered wall portion extending about its outer periphery, said inner cover being adapted to be disposed within said mouth with said tapered portions in opposition to one another and defining an inwardly narrowing taper space therebetween which receives and entraps said seal member when said lever is moved to said locked position.

17. A hatch locking mechanism as set forth in claim 16, including a second resilient seal member disposed between said inner and outer covers adjacent said central support shaft.

* * * * *